US005560182A

United States Patent [19]

Garwood

[11] Patent Number: 5,560,182

[45] Date of Patent: Oct. 1, 1996

[54] PACKAGING METHOD

[75] Inventor: Anthony J. M. Garwood, Zionsville, Ind.

[73] Assignee: Seawell North America Inc., Wilmington, Del.

[21] Appl. No.: 411,143

[22] Filed: Mar. 27, 1995

Related U.S. Application Data

[63] Continuation of Ser. No. 137,935, Oct. 19, 1993, abandoned, which is a continuation of Ser. No. 877,186, filed as PCT/AU91/00015, Jan. 16, 1991, published as WO91/10593, Jul. 25, 1991, abandoned.

[30] Foreign Application Priority Data

Jan. 19, 1990 [AU] Australia ..... PJ8256
Jan. 16, 1991 [WO] WIPO ..... PCT/AU91/00015

[51] Int. Cl.[6] ..... B65B 31/02

[52] U.S. Cl. ..... 53/432; 53/449; 53/510; 426/118; 426/129

[58] Field of Search ..... 53/432, 433, 510, 53/511, 449, 173, 453, 559; 426/118, 129

[56] References Cited

U.S. PATENT DOCUMENTS

| | | | |
|---|---|---|---|
| 3,216,832 | 11/1965 | King | 53/433 |
| 3,481,100 | 12/1969 | Bergstrom | 53/433 |
| 3,659,393 | 5/1972 | Richter | 53/433 |
| 3,673,760 | 7/1972 | Canamero et al. | 53/433 |
| 4,294,859 | 10/1981 | Lundquist et al. | 53/433 X |
| 4,581,764 | 4/1986 | Plock et al. | 53/433 X |
| 4,685,274 | 8/1987 | Garwood | 53/433 |
| 4,840,271 | 6/1989 | Garwood | 206/213.1 |
| 4,909,022 | 3/1990 | Kubis et al. | 53/510 |
| 5,025,611 | 6/1991 | Garwood | 53/510 X |
| 5,103,618 | 4/1992 | Garwood | 53/433 |
| 5,115,624 | 5/1992 | Garwood | 53/432 X |
| 5,155,974 | 10/1992 | Garwood | 53/510 |
| 5,419,096 | 5/1995 | Gorlich | 53/510 X |
| 5,428,943 | 7/1995 | Balcombe | 53/432 |

FOREIGN PATENT DOCUMENTS

| | | |
|---|---|---|
| WP87/02965 | 5/1987 | WIPO . |
| WO88/00907 | 2/1988 | WIPO . |
| WO90/01005 | 2/1990 | WIPO . |

*Primary Examiner*—Horace M. Culver
*Attorney, Agent, or Firm*—Foley & Lardner

[57] ABSTRACT

A method of packaging goods such as red meats is disclosed. The goods (5) are packaged on a base (1) with an inner skin lid (11) which at least partially skin packs the goods (5) to the base (1) to hold the goods (5) to the base (1). An outer lid (7) is placed over the inner skin lid (11)and gas pressure is reduced therebetween causing the inner skin lid (11) to be urged relatively towards the undersurface of the outer lid (7). The outer lid (7) is then sealed to the inner lid (11) and the base (1). The inner skin lid (11) is of a material which will allow a required gas such as $O_2$ to penetrate the inner skin lid (11) when the outer lid (7) is opened, removed or ruptured to, in turn, allow the red meat, if discolored, to bloom to a red color. The method enables unwanted gases such as $O_2$ to be substantially excluded from the packaging until the outer lid (7) is opened, removed or ruptured.

20 Claims, 2 Drawing Sheets

PACKAGING METHOD

This application is a continuation of application Ser. No. 08/137,935, filed Oct. 19, 1993, and now abandoned, which in turn is continuation application of Ser. No. 07/877,186, filed Jul. 7, 1992, and now abandoned, which is the national stage of PCT/AU91/00015 filed Jan. 16, 1991.

FIELD OF THE INVENTION

This invention relates to an improved packaging method and relates particularly but not exclusively, to a packaging method for red meats.

DESCRIPTION OF PRIOR ART

Hitherto there have been many proposals for the packaging of perishable goods such as foodstuffs and in particular red meats. Certain examples are disclosed in U.S. patent specification Nos. 4,685,274, 4,840,271 and published PCT patent specification no. PCT/AU87/00297 and PCT patent specification PCT/AU87/00243. The inventor herein is the inventor in respect of the aforementioned patents/applications. The subject matter of the published specifications relating to the aforementioned patents/applications is hereby incorporated by reference.

In the aforementioned specifications there is disclosed the use of a plastics material base, goods on the base, a plastics material flexible web which skin packs or partially skin packs the goods to the base and a lid over the base. The base and the lid are substantially gas impervious whilst the flexible web is gas permeable. A gas for enhancing preservation of the packaged goods is provided in a space between the lid and the flexible web. In use, the gas permeates the flexible web and enhances preservation of the packaged goods.

It has been found desirable to provide a slightly different type of packaging where the goods are packaged together with a desired gas, such as $N_2$ substantially with all unwanted gases removed. To exclude substantially, all of the unwanted gases presents considerable difficulty particularly in commercial production environment where considerable packaging throughput is required. This desired gas is referred to as inert in the food packaging arts because it does not substantially affect the goods and keeps bacteria growth to a minimum. Other gases than $N_2$ can be used such as $CO_2$, $SO_2$, $S_2O_3$, and others, all known for enhancing preservation. An appropriate one or more of these gases is chosen to suite the goods which are packed. The goods, such as red meats, are expected to discolour with time. The packaging is then processed as by opening or rupturing the lid so that oxygen or other suitable gas can contact the skin packaging web and permeate that web to attempt to restore an original colour to the packaged goods.

If unwanted gas such as $O_2$ remains in the packaging with the lid, red meat will discolour dark brown with time. Thus, the unwanted gas such as $O_2$ should be substantially excluded from the packaging until restoration of the colour is required. The method also enables a lid larger than the base to be applied so the overhang of the lid can be gripped to permit peeling of the lid off the base to allow a gas such as $O_2$ to then permeate the remaining inner skin lid to attempt to restore the original colour.

OBJECTS AND STATEMENT OF INVENTION

Accordingly, it is an object of the present invention to provide improved methods for producing such packaging.

Therefore in accordance with a first broad aspect of the present invention there may be provided a method of packaging goods comprising providing a base, placing goods over said base, placing an inner skin lid over said goods, placing an outer lid over said inner skin lid, sealing said inner skin lid to said base in at least partial skin packing relation to said goods to hold said goods to said base, causing said inner skin lid to be urged relatively towards the under surface of said outer lid to displace unwanted gas by reducing gas pressure therebetween, and thereafter, sealing said outer lid relative to said inner skin lid and said base whilst in the urged condition, said inner skin lid being of a material to allow a required gas to permeate said inner skin lid when said outer lid is removed, ruptured or opened, said base and said outer lid being of material which will substantially inhibit undersired gas to contact said goods.

Most preferably, the method also involves introducing a desired gas between said inner skin lid and said outer lid prior to sealing said outer lid relative to said inner skin lid so there is a space therebetween which contains said desired gas, sealing said outer lid relative to said inner skin lid and said base.

Most preferably said outer lid is sealed over said inner skin lid so said outer lid is removable or is openable without rupturing of said inner skin lid to allow a further desired gas to permeate said inner skin lid and contact said goods.

Most preferably the outer lid overhangs the outermost periphery of said base and said inner skin lid to permit easy gripping for subsequent peeling off of said outer lid.

BRIEF DESCRIPTION OF THE DRAWINGS

In order that the invention can be more clearly ascertained examples of preferred embodiments will now be described with reference to the accompanying drawings wherein.

DETAILED DESCRIPTION OF PREFERRED EMBODIMENTS

Figure 1:
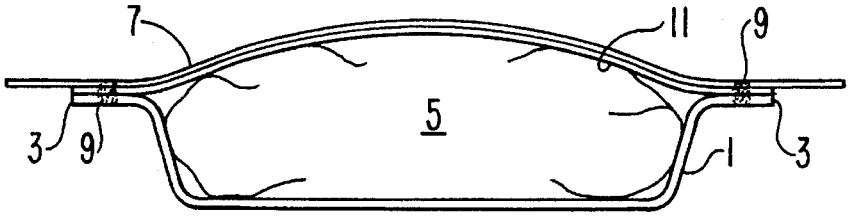
FIG. 1 is a side cross-sectional view of one example of packaging in accordance with the present invention.

Referring firstly to FIG. 1, there is shown a plastics material base 1 made from a substantially gas impervious material such as PVC. The base 1 is generally rectangular in configuration and has a generally cup-shaped depression with a peripherally extending lip 3. Goods 5 are placed over the base 1 so that they are received in the cup-shaped depression. A lid 7 is applied over the base 1 and is sealed completely around the peripheral lip 3 by a continuous seal 9. The seal 9 may be effected by a heat sealing process known in this art, such as by an impulse heat sealing process. Typically the lid 7 can be of PVC or other suitable plastics material. An inner flexible skin lid 11 is provided between the lid 7 and the base 3. The inner skin lid 11 is produced from a highly flexible plastics material which is selected to allow a desired gas to permeate said inner skin lid 11. The gas may assist in maintaining bacteria growth to a minimum or may be a gas which will assist maintenance of an original colour of the packaged goods. In the case of red meats, it is known they will turn dark brown in time owing to the depletion of oxygen from the blood. The original red colour can be at least partially restored by exposing the meat to oxygen. Thus, in one example, the inner skin lid 11 may be pervious to oxygen. The lid 7 overhangs the periphery of the base 1, preferably all the way around its perimeter to permit peeling off from the base.

Thus, in the case of red meats which are packaged in the packaging shown in FIG. 1, the base 1 and the lid 7 will be substantially gas impervious. Thus, the contents of the package will be subject to the gas environment therein which can be chosen for its preservation of the meat. The meat will, in time, turn dark brown. By removing the lid 7 by grasping the overhang or by opening the lid 7 by providing an aperture in the lid 7 or by other means, the original red colour of the meat can be at least partially restored as a required gas such as oxygen in the atmosphere which will then contact be inner skin lid 11 and will then permeate the inner skin lid 11 and contact the goods 5. A typical example of a plastics material for the inner skin lid 11 is a low density polyethylene. Other plastics material having the desired gas barrier and/or permeability characteristics may be employed as would be apparent to a person skilled in the packaging arts. In certain cases it may be necessary to provide multi-layered webs of plastics material for each of the base 1, the lid 7 and the inner skin lid 11 in order to obtain the desired gas barrier properties and the desired gas permeability properties whilst permitting all of the plastics materials to be bonded to one another. In the case where the lid 7 is to be peeled from the base 1 whilst leaving the inner skin lid 11 intact, it is particularly preferred that each of the base 1, the-lid 7 and the inner skin lid 11 be made from multi-layered webs of plastics materials. In this case, the necessary adhesion between the base 1 add the inner skin lid 11, and the inner skin lid 11 and the lid 7 can be appropriately chosen to allow easy separation of the lid 7. Suitable plastics materials are as follows:

Base 1 . . . UPVC/adhesive/LDPE

Lid 7 . . . Nylon/adhesive/LDPE plus a contaminant such as Suryln (Trade Mark)

The contaminant is blended in small quantities with the LDPE to reduce the resultant bonding qualities of lid 7.

Inner lid 11 . . . LDPE

Typically the base 1 is of a thickness from about 50 microns to 1000 microns. Thus, the base 1 can be substantially rigid. If desired the base 1 may be manufactured from a multi-layer material including a barrier layer and a foamed polystyrene layer and accordingly it may have a thickness of about 1000 to 3000 microns. The inner skin lid 11 may have a thickness from 10 to 100 microns. The lid 7 may have a thickness of between about 20 microns to 1000 microns. Thus, the lid 7 may be substantially rigid also. If desired, the lid 7 may be manufactured from a multi-layer foamed polystyrene with a barrier layer or from other cheap plastics such as recycled polyester. It should be appreciated that the lid 7 is not normally exposed to a purchasing consumer. In practice the package will be supplied to a retail outlet and stored until required to be displayed on sales shelves. When the product is to be displayed, the lid 7 can be removed or opened or punctured to allow the necessary gas to then permeate the inner skin lid 11. Thus, under certain conditions the lid 7 will not be seen by the purchasing public.

The above examples of plastics materials and their thickness ranges is not to be considered exhaustive but merely exemplary of certain plastics and the thickness ranges which are suitable.

In the embodiment of FIG. 1, it can be seen that the goods 5 are firmly contacted by the inner skin lid 11 and that the inner skin lid 11 closely follows the contour of the lid 7. In practice it is proposed that in this embodiment the lid 7 and the inner skin lid 11 be in close contact so it will appear that there is only a single lid. It is to be noted that the seal 9 is substantially uniform in width through the lid 7, the inner skin lid 11 and the lip 3. Thus, when the lid 7 is removed from the base 1 by peeling it therefrom, the peeling action will not rupture the inner skin lid 11 which is of relatively thinner and weaker plastics material than that of the lid 7 or the base 3. This is because the interface between the adjacent layers of the lid 7, the inner skin lid 11 and the base 3 at the seal 9 will permit the peeling action whilst supporting that portion of the inner skin lid 11 forming the seal 9 by the relatively more rigid peripheral lip 3. In addition, the bonding of the seal 9 between the lid 7 and the inner skin lid 11 is weaker than the bonding between the inner skin lid 11 and the base 3.

In the construction shown in FIG. 1 the packaging holds the goods 5 firmly to the base 1. Typically, the base 1, goods 5 and inner skin lid 11 are formed as a pre-pack by known skin packing techniques and outer lid 7 applied over the pre-pack.

Figure 2:
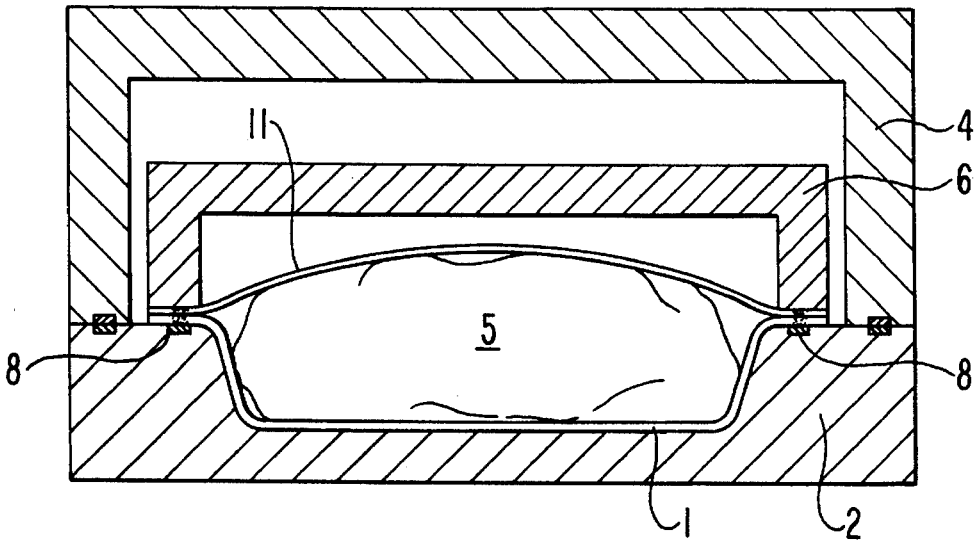
FIG. 2 is a side cross-sectional view of a known pre-pack skin packaging station used in a method in accordance with the present invention.

In the embodiment shown in FIG. 2 there is shown a typical skin packaging apparatus for producing skin packed goods. Here there is provided a lower chamber 2 and an upper chamber 4. The lower chamber 2 and the upper chamber 4 can be closed and sealed together and gas, such as atmosphere, evacuated from the closed chamber parts. A platen 6 within the closed chamber parts 2 and 4 can then be lowered to enable sealing of the inner skin lid 11 to the base 1 with the goods 5 therebetween. It is noted that the goods 5 are above the upper peripheral lip of the base 1 and thus there will be a degree of stretching of the lid 11 over the goods 5. An electric heating strip 8 on the chamber part 2 extends continuously around the package where a seal is required between the base 1 and the lid 11. When the platen 6 is lowered the heating strip 8 can be electrically activated so that there will be heat sealing and bonding of the inner skin lid 11 to the base 1. When the chamber parts 2 and 4 are opened, atmospheric pressure causes the inner skin lid 11 to tightly urge on to the goods 5 and at least partially skin pack the goods 5 to the base 1. Thus, the goods 5 will be held tightly to the base 1. If desired, before sealing of the inner skin lid 11 to the base 1, a desired gas can be introduced into the closed chamber parts 2 and 4 to replace atmospheric gas so that a desired gas will be retained between the base 1 and the inner skin lid 11. This gas should be at a pressure less than atmospheric so that when the chamber parts 2 and 4 are opened the inner skin lid 11 will at least partially skin pack the goods 5 to the base 1 so that the goods 5 cannot move around on the base 1. Such apparatus is considered well known in the packaging arts. The inner skin lid 11 may be preheated by means not shown to assist in the partial skin packing.

Figure 3:
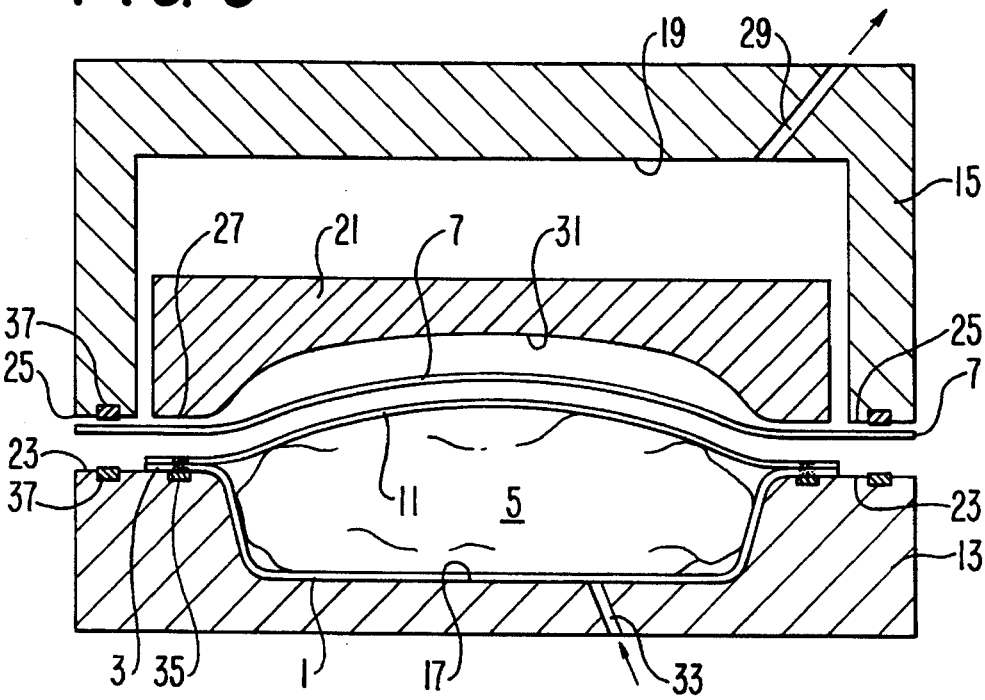
FIG. 3 is a side cross-sectional view taken through apparatus used for producing the packaging shown in FIG. 1.

Referring now to FIG. 3, there is shown apparatus for producing the packaging of FIG. 1. The apparatus has a lower chamber part 13 and an upper chamber part 15. The lower chamber part 13 has a cavity 17 of a size to neatly receive a pre-pack base 1 and inner skin lid 11. The upper chamber part 15 has a cavity 19 in which is provided a movable intermediate chamber part 21. The upper and lower chamber parts 13 and 15 are relatively movable towards and away from each other to effect opening and closing and to permit insertion and removal of the lid 7, and the pre-pack base 1 and inner skin lid 11. Each of the lower, upper and intermediate chamber parts 13, 15 and 21 is movable by suitable rams or air bag means known in the packaging art. Accordingly, details have not been shown.

It is to be noted that the lower chamber part 13 has a forward face 23 whilst the upper chamber part has a forward face 25 which sealingly mates with forward face 23. The intermediate chamber part 21 has a forward face 27 which mates with forward face 23.

In use of the apparatus, a pre-pack base 1 and inner skin lid 11 is provided in the cavity 17 in the lower chamber part 13. Optional heating means (not shown) can be provided to heat inner skin lid 11 to a suitable processing temperature. The outer lid 7 is then placed over the inner skin lid 11 and each assumes the positions as shown. Suitable guide pins (not shown) or other means (not shown) can be used to hold the packaging components in the desired positions. The upper and lower chamber parts 13 and 15 are then closed or at least partially closed. The intermediate chamber part 21 is then brought down towards a fully closed position with the lower chamber part 13 but not to a sealing position where the outer lid 7 will be held sealed closed with the inner skin lid 11. Air is then exhausted through air exhaust 29 to a pressure less than that under the inner skin lid 11 in the pre-pack. This, in turn, will cause the flexible inner skin lid 11 to expand radially outwardly and push against the innermost surface of outer lid 7 to, in turn, push outer lid 7 against the under surface 31 of the intermediate chamber part 21. This is because there will be a greater gas pressure within the package than in the chamber causing that gas to expand. The expansion of the inner skin lid 11 in this manner will displace substantially all the air or gas such as $O_2$ between the inner skin lid 11 and the outer lid 7, thus effecting close mating relationship of the inner skin lid 11 with the outer lid 7. The heating of the inner skin lid 11 by the heating means (not shown) to a temperature for processing will assist in the inner skin 11 moving in this manner.

The expansion of the inner skin lid 11 to the outer lid 7 is limited by the shape and size of the undersurface 31 of the intermediate chamber part 21. Thus, good control can be achieved over the expansion and movement of the outer lid 7 and inner skin lid 11 by appropriate shaping of undersurface 31.

Desirably, the outer lid 7 is sized to neatly fit over the inner skin lid 11 so that the goods 5 are still at least partially held to base 1 during this outer expansion. The undersurface of the intermediate chamber part 21 is thereto sized and spaced from the lower chamber part 13 to provide this result.

Following the exhausting of gas from air exhaust 29, then the intermediate chamber part 21 is relatively moved with lower chamber part 13 to effect sealing of the outer lid 7 to inner skin lid 11 to the lip 3 of the base 1. An electric heat impulse sealing strip 35 of known construction is provided in the lower chamber part 13 and extends continuously around the lip 3 so that when activated it can effect such sealing. Pressure is maintained between the intermediate chamber part 21 and the lower chamber part 13 during the sealing process. In the embodiment shown this seal coincides with the seal on the pre-pack.

Seal means 37 are shown in the lower chamber part 13 and upper chamber part 15 to effect good air or gas sealing between the lower chamber part 13 and upper chamber part 15 when this is required. The seal means 37 can be a rubber-like material which extends peripherally around the forward faces 25 and 23 of the respective upper chamber part 15 and lower chamber part 13.

Following the sealing of the outer lid 7 to the inner skin lid 11 to the base 1, the upper chamber part 15, lower chamber part 13 and intermediate chamber part 21 can be opened so that the packaging will be exposed to atmospheric pressure. The outer lid 7 and the inner skin lid will then collapse slightly under atmospheric pressure and thereby tightly hold the goods 5 to the base 1 within the packaging. The packaging can then be removed from the chamber parts 13, 15 and 21.

It should be noted that the inner skin lid 11 is sheet like—without openings or holes—so it can be skin wrapped over goods 5 on the base 1, and so it can, in turn, be inflated up against the undersurface of outer lid 7. Thus, whilst the inner skin lid 7 is gas permeable, it is only gas permeable over an extended period of time, and it is not freely gas permeable to the extent as could be experienced with a gauze or mesh like web.

The outer lid 7 can then, if required, be subject to heat to relieve any thermal or other stress therein caused by the packaging process.

Typically a machine could be provided which manufactures packing of the type disclosed by producing the packaging in a continuous elongate web. In this connection there would be first elongate web in which bases 1 are provided, a further elongate web from which inner skin lids 11 are provided as pre-packs, and a further elongate web from which lids 7 are provided. When the packaging exits from the chamber parts 13, 15 and 31, the individual packages can be cut from the continuous elongate webs of packaging material by a suitable cutting means.

In use, the outer lid 7 can be peeled from the base 1 whilst leaving the inner skin lid 11 intact and sealed to the base 1 around the seal 9. The required gas for red meats, such as $O_2$ in normal atmosphere, can then permeate the inner skin lid 11 to contact the meat. The remaining pre-pack comprising the base 1 and the inner skin lid 11 represents a pleasing package to an intending purchaser. Suitable advertising material may be printed on either or both of the base 1 or the inner skin lid 11. Typically, the inner skin lid 11 is of a clear transparent material so the contents can be viewed easily.

Figure 4:
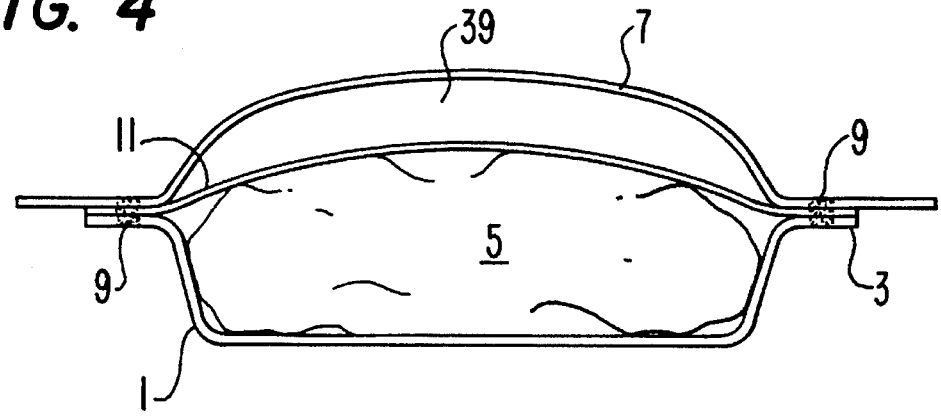
FIG. 4 is a side cross-sectional view of a third example of packaging in accordance with the present invention.

Referring now to FIG. 4 there is shown a variation of the packaging shown in FIG. 1 where like components have the same numerical designations. In this embodiment the packaging is produced in the same manner as in the previous embodiment but before sealing of lid 7 to the base a desired gas is provided in a space 39 which is then produced between the outer lid 7 and the inner skin lid 11. In other words, substantially all the gas between inner skin 11 and outer lid 7 is excluded by expansion of the inner skin lid 11 to the undersurface of outer lid 7 as described and then a desired gas is forced between the inner skin 11 and outer lid 7. The desired gas can permeate the inner skin lid 11 to contact the goods to enhance preservation. The inflation of outer lid 7 relative to inner skin lid 11 with such gas will assist in providing shock absorption properties to the package to inhibit against rupture of outer lid 7, particularly when a large number of such packages are carted in stacks or packages.

Figure 5:
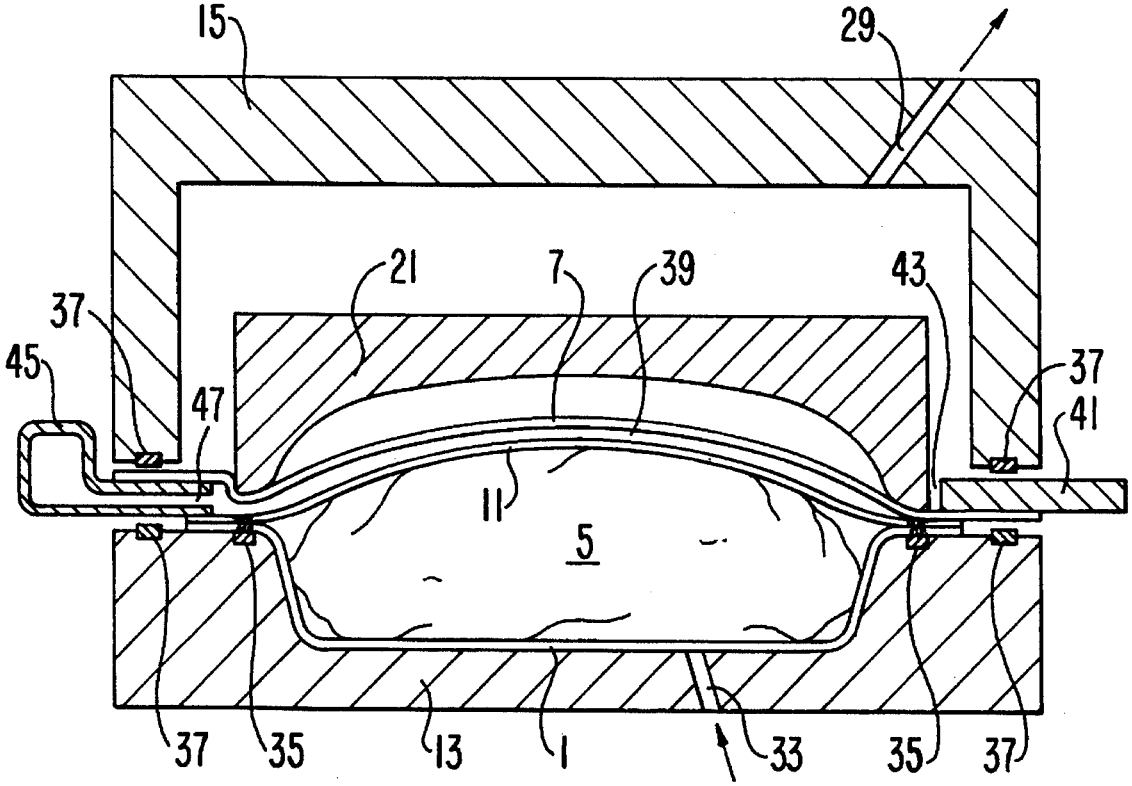
FIG. 5 is a side cross-sectional view taken through apparatus used for producing the packaging shown in FIG. 4.

In this embodiment the gas provided in the space 39 can be provided by means of plate means which forms a gas flushing member of the type disclosed in the aforementioned U.S. specification 4,685,274. In this case the gas flushing member will be placed between the outer lid 7 and the inner skin lid 11 so that the forward face 27 on the intermediate chamber part 21 can pass between a central opening in the gas flushing member to effect sealing by the impulse sealing strip 35. A diagrammatic sketch of the gas flushing member is shown in FIG. 5 in combination with the chamber parts 13, 15 and 21 shown in FIG. 3. In this embodiment the gas flushing member is shown by numeral 41 and comprises a plate with a rectangular shaped central opening 43 which corresponds to the shape of the required package. The gas flushing member 41 has a chamber 45 through which a desired gas can be emitted to pass through a gas outlet opening 47 . Thus, when the upper chamber part 15 and lower chamber 13 close they close on the faces of the gas flushing member 41. When the intermediate chamber part 21 closes on the lower chamber part 13 it passes through the opening 43. The gas which is passed through the opening 47 is then provided between the inner skin lid 11 and the outer lid 7. When sealing takes place on closing of the intermediate chamber part 21 with the lower chamber part 13 the gas which has passed through the opening 47 is then sealed in the space 39 between the outer lid 7 and the lid 11. This desired gas can be chosen for permeating the inner skin lid 11 with time for enhancing preservation of the goods. Typically the gas can be $N_2$ or other known gas or gases which can enhance keeping of the red meat. The gas should be at a pressure greater than the pressure under inner skin lid 11 so inner skin lid 11 will be urged thereby into at least partial skin packing relation with the goods 5. Desirably, the gas is at a pressure slightly less than atmosphere pressure.

Modifications may be made to the present invention as would be aparent to persons skilled in the packaging art. These and other modifications may be made without departing from the ambit of the invention, the nature of which is to be determined from the foregoing description.

I claim:

1. A method of packaging goods comprising providing a base, placing goods over said base, placing an inner skin lid over said goods, placing an outer lid over said inner skin lid, said outer lid having an undersurface, sealing said inner skin lid to said base to hold said goods relative to said base, causing said inner skin lid to be urged relatively towards the undersurface of said outer lid to displace unwanted gas by reducing gas pressure between said inner skin lid and said outer lid, and thereafter sealing said outer lid relative to said inner skin lid and said base while in the urged condition, said inner skin lid being of a material to allow a required gas to permeate said inner skin lid when said outer lid is removed, ruptured or opened, said base and said outer lid being of material which will substantially inhibit undesired gas external of the package from contacting said goods.

2. A method as claimed in claim 1, further comprising the step of introducing a desired gas between said inner skin lid and said outer lid prior to sealing said outer lid relative to said inner skin lid so there is a space therebetween which contains said desired gas, and sealing said outer lid relative to said inner skin lid and said base.

3. A method as claimed in claim 1, further comprising the step of sealing said outer lid relative to said inner skin lid and said base with a seal which can allow said outer lid to be peeled from said packaging leaving said base and said inner skin lid intact and unruptured.

4. A method as claimed in claim 3, further comprising the step of sealing said outer lid relative to said inner skin lid and said base with a portion of said outer lid overhanging the periphery of said inner skin lid and said base to permit easy gripping for subsequent peeling off of said outer lid.

5. A method as claimed in claim 1, wherein said base has a generally cup-shaped depression therein in which said goods are received, and further including the steps of:

choosing the size of said goods relative to the depression so the top of said goods will extend above the top of the depression when said goods are placed in said depression, placing said goods in said depression, and causing said inner skin lid to stretch over said goods when said inner skin lid is sealed to said base in at least partial skin packing relation to said goods.

6. A method as claimed in claim 5, wherein said outer lid is shaped and sized to neatly fit over said inner skin lid and said goods, and further including the steps of:

positioning said outer lid over said inner skin lid and said goods in such relationship, and supporting said outer lid in that relationship while said inner skin lid is caused to be urged relatively towards the undersurface of said outer lid whereby said goods will still be held to said base during such urging.

7. A method as claimed in claim 2, further comprising the step of introducing said desired gas at a pressure greater than a gas pressure between said inner skin lid and said base.

8. A method as claimed in claim 7, wherein said desired gas is at a pressure slightly less than atmospheric pressure.

9. A method as claimed in claim 1, further comprising the step of heating said inner skin lid to a forming temperature to assist in enabling said inner skin lid to be urged towards said outer lid.

10. A method as claimed in claim 1, further including the step of applying a platen to the outer lid to limit movement of said outer lid and said inner skin if said inner skin lid should engage said outer lid as it is urged relatively towards the undersurface of said outer lid.

11. A method of packaging goods, said method having the following steps:

(a) providing three overlapping webs, the two outer webs being gas barrier webs and the inner web being a gas permeable web;

(b) providing goods between one of said gas barrier webs and said gas permeable web;

(c) sealing said goods between said one gas barrier web and said gas permeable web so that said goods are therebetween, said sealing being effected by sealing means which defines a seal path near what will be the perimeter of the packaging and which extends completely around said seal path;

(d) sealing closed a chamber about the three webs and the goods, evacuating air from said chamber to lower air pressure in said chamber to permit said gas permeable web to be urged relatively towards the undersurface of the other gas barrier web to displace gas therebetween, and thereafter sealing said other gas barrier web relative to said gas permeable web and said one barrier web while the gas permeable web is in the urged condition, said gas permeable web permitting a required gas to permeate therethrough when said other gas barrier web is removed, ruptured or opened.

12. A method as claimed in claim 11, comprising the further steps of:

introducing a desired gas between said gas permeable web and the other of said gas barrier webs prior to sealing said other gas barrier web relative to said gas permeable web so that there is a space therebetween which contains said desired gas; and sealing said other gas barrier web relative to said gas permeable web and said one gas barrier web.

13. A method as claimed in claim 1, comprising the further step of sealing said other gas barrier web relative to said gas permeable web and said gas barrier web with a seal which allows said other gas barrier web to be peeled from said packaging, thereby leaving said one gas barrier web and said gas permeable web intact and unruptured.

14. A method as claimed in claim 13, comprising the further steps of sealing said other gas barrier web relative to said gas permeable web and said one gas barrier web with a portion of said other gas barrier web overhanging the periphery of said gas permeable web and said one gas barrier web to permit easy gripping for subsequent peeling off of said other gas barrier web.

15. A method as claimed in claim 11, wherein said one gas barrier web has a generally cup-shaped depression therein in which said goods are received, and comprising the further steps of:

choosing the size of said goods relative to the depression so the top of said goods will extend above the top of the depression when said goods are place in said depression;

placing said goods in said depression; and causing said gas permeable web to stretch over said goods when said gas permeable web is sealed to said one gas barrier web in at least partial skin packing relation to said goods.

16. A method as claimed in claim 15, wherein said other gas barrier web is shaped and sized to neatly fit over said gas permeable web and said goods, and comprising the further steps of:

positioning said other gas barrier web over said gas permeable web and said goods in such relationship; and supporting said other gas barrier web in that relationship while said permeable web lid is caused to be urged relatively towards the undersurface of said other gas barrier web whereby said goods will still be held to said one gas barrier web during such urging.

17. A method as claimed in claim 12, comprising the further steps of introducing said desired gas at a pressure greater than a gas pressure between said other gas permeable web and said other gas barrier web.

18. A method as claimed in claim 17, wherein said desired gas is at a pressure slightly less than atmospheric pressure.

19. A method as claimed in claim 11, comprising the further steps of heating said gas permeable web to a forming temperature to assist in enabling said gas permeable web to be urged towards said other gas barrier web.

20. A method as claimed in claim 11, further including the step of applying a platen to said other gas barrier web towards which the inner skin lid is urged, thereby limiting movement of said other gas barrier web and said inner skin lid if said inner skin lid should engage said other gas barrier web as it is urged relatively towards the undersurface of said other gas barrier web.

* * * * *